US005928849A

United States Patent [19]

Wheeler et al.

[11] Patent Number: 5,928,849

[45] Date of Patent: Jul. 27, 1999

[54] BLACK AND WHITE PHOTOGRAPHIC ELEMENT

[75] Inventors: Christopher Edwin Wheeler, Fairport; Robert Bruce Bayley, Hilton; Michael Kent Coil, Fairport; Margaret Jones Helber, Rochester, all of N.Y.

[73] Assignee: Eastman Kodak Company, Rochester, N.Y.

[21] Appl. No.: 08/688,181

[22] Filed: Jul. 31, 1996

[51] Int. Cl.[6] ..... G03C 1/06; G03C 1/815; G03C 1/825

[52] U.S. Cl. ..... 430/522; 430/510; 430/517; 430/570; 430/581; 430/585

[58] Field of Search ..... 430/510, 517, 430/522, 570, 581, 585

[56] References Cited

U.S. PATENT DOCUMENTS

| | | | |
|---|---|---|---|
| 3,072,509 | 1/1963 | Barnhart et al. | 149/2 |
| 3,177,210 | 4/1965 | Rosenoff | 260/240.65 |
| 3,247,127 | 4/1966 | Bailey | 430/517 |
| 3,522,052 | 7/1970 | Shiba et al. | 96/104 |
| 4,042,397 | 8/1977 | Moelants et al. | 430/517 |
| 4,092,168 | 5/1978 | Lemahieu et al. | 96/84 |
| 4,770,984 | 9/1988 | Ailliet et al. | 430/505 |
| 4,857,446 | 8/1989 | Diehl et al. | 430/510 |
| 4,877,721 | 10/1989 | Diehl et al. | 430/522 |
| 4,895,786 | 1/1990 | Kurematsu et al. | 430/522 |
| 4,902,784 | 2/1990 | Hopf et al. | 534/556 |
| 4,956,269 | 9/1990 | Ikeda et al. | 430/522 |
| 4,988,611 | 1/1991 | Anderson et al. | 430/494 |
| 5,326,686 | 7/1994 | Katoh et al. | 430/522 |
| 5,346,810 | 9/1994 | Ohno | 430/522 |
| 5,451,494 | 9/1995 | Diehl et al. | 430/522 |
| 5,459,265 | 10/1995 | Wariishi et al. | 544/300 |
| 5,641,617 | 6/1997 | Nishio | 430/522 |

FOREIGN PATENT DOCUMENTS

| | | |
|---|---|---|
| 0 582 000 | 2/1994 | European Pat. Off. . |
| 679 939 A1 | 11/1994 | European Pat. Off. . |
| 679939 | 11/1995 | European Pat. Off. . |
| 62-253146 | 4/1986 | Japan . |
| 4-352151 | 12/1992 | Japan . |
| 5-45787 | 2/1993 | Japan . |
| 7-104429 | 4/1995 | Japan . |
| 8-082 881 | 3/1996 | Japan . |
| 8-82881 | 3/1996 | Japan . |
| 2308456 | 6/1997 | United Kingdom . |

OTHER PUBLICATIONS

Japanese Patent Abstract JP 7104429.

*Primary Examiner*—Geraldine Letscher
*Attorney, Agent, or Firm*—Edith A. Rice

[57] ABSTRACT

A black and white photographic element contains a filter dye of Formula (I):

(I)

wherein each $R^1$ is independently substituted or unsubstituted alkyl, substituted or unsubstituted alkoxy, cyano, hydroxy, carboxy, substituted or unsubstituted amido, or substituted or unsubstituted sulfonamido;

n is 1–4;

$R^2$ is H, substituted or unsubstituted alkyl or amido;

each of $R^3$ and $R^4$ is independently hydrogen or substituted or unsubstituted alkyl; and M is a cation.

14 Claims, No Drawings

BLACK AND WHITE PHOTOGRAPHIC ELEMENT

FIELD OF THE INVENTION

This invention relates to a black and white photographic element containing a barbituric acid filter dye.

BACKGROUND OF THE INVENTION

Filter dyes are widely used in photographic elements and can be located in various locations in an element to absorb undesired light. In certain black and white photographic elements, such as film, it is desirable to be able to load the film into the camera, or other imaging device, under standard room light conditions. To prevent fogging of the photographic element, a filter layer that absorbs across the entire visible spectrum is provided. The filter layer contains one or more dispersed filter dyes to provide the desired absorption. The filter layer is typically positioned between the support and the light sensitive layer(s) of the photographic element or on the back side of the support. In particular, the filter dyes can be located in an antihalation layer or a pelloid layer.

A filter dye that is used in such a filter dye layer in commercial microfilm to permit room light loading of the film is disclosed in U.S. Pat. No. 4,092,168 ("the '168 patent"). However, filter dyes of the type disclosed in the '168 patent have been found to result in loss of speed of the film, when the photographic element is stored prior to exposure under elevated temperatures, e.g., above about 20° C., and high relative humidity conditions, i.e., relative humidity above about 50%. This is particularly true when the light sensitive layer(s) of the photographic element is sensitized with certain red sensitizing dyes.

Microfilm can be used with various computer output devices, such as writers, that utilize a cathode ray tube, light emitting diode, laser or other light source to form the desired image on the microfilm. In a recently developed writer, a LED that emits light at a wavelength of about 680 nm is used. Microfilm for use with this writer contains a layer sensitive to light of this wavelength. The use of a filter dye of the type disclosed in the '168 patent does not adequately protect the light sensitive layer from light having a wavelength of about 680 nm and thus does not adequately protect the light sensitive layer when the film is loaded under room light into the writer. Further the film tends to lose speed if stored under high temperature and high relative humidity conditions.

PROBLEM TO BE SOLVED BY THE INVENTION

It is an objective of this invention to provide a black and white photographic element that can be loaded under room light conditions and that does not lose speed when stored prior to exposure under high temperature and high humidity conditions. In a preferred embodiment, this invention provides a black and white photographic element that can be used with a writer having a light source that emits light having a wavelength of about 680 nm.

SUMMARY OF THE INVENTION

This invention comprises a black and white photographic element comprising at least one silver halide light sensitive layer and at least one non-light sensitive layer, wherein the non-light sensitive layer comprises a solid particle dye dispersion of a barbituric acid oxonol filter dye of Formula (I):

(I)

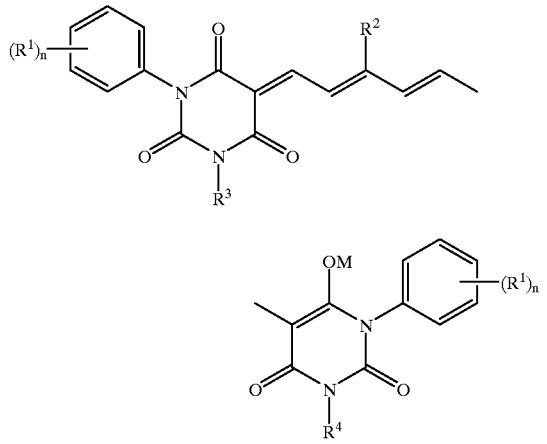

wherein:

each $R^1$ is independently substituted or unsubstituted alkyl, substituted or unsubstituted alkoxy, cyano, hydroxy, carboxy, substituted or unsubstituted amido, or substituted or unsubstituted sulfonamido;

n is 1–4;

$R^2$ is H, substituted or unsubstituted alkyl or amido;

each of $R^3$ and $R^4$ is independently hydrogen or substituted or unsubstituted alkyl; and M is a cation.

The non-light sensitive layer containing the solid particle dye dispersion is preferably an antihalation layer or a pelloid layer.

ADVANTAGEOUS EFFECT OF THE INVENTION

The invention provides a black and white photographic element, particularly useful as microfilm, that can be handled under standard room light conditions and is storage stable even when stored at temperatures above about 20° C. and relative humidity of greater than 70%.

DETAILED DESCRIPTION OF THE INVENTION

Representative barbituric acid oxonol dyes that can be used in accordance with this invention are:

TABLE A (I)

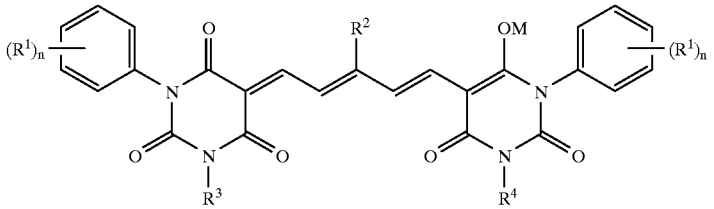

| Dye No. | $R^1$ | $R^2$ | $R^3$ | $R^4$ | M |
|---|---|---|---|---|---|
| FD-1 | 4-OH | H | H | H | H |
| FD-2 | 4-COOH | H | H | H | H |
| FD-3 | 4-$CH_3$ | H | H | H | H |
| FD-4 | 4-COOH | $CH_3$ | H | H | H |
| FD-5 | 4-$OCH_3$ | $CH_3$ | H | H | H |
| FD-6 | 4-COOH | H | H | H | TEAH* |
| FD-7 | 4-$OCH_3$ | H | H | H | H |
| FD-8 | 3-$OCH_3$ | H | H | H | H |
| FD-9 | 2-$OCH_3$ | H | H | H | H |
| FD-10 | 4-OH | $CH_3$ | H | H | H |
| FD-11 | 2-OH | H | H | H | H |
| FD-12 | 3-Cl | H | H | H | H |
| FD-13 | 4-$CONH_2$ | H | H | H | H |
| FD-14 | 3-$CH_3$ | H | H | H | H |
| FD-15 | 4-$OCH_3$ | $CONH_2$ | H | H | TEAH* |
| FD-16 | 3-COOH | H | H | H | H |
| FD-17 | 4-$NHCOCH_3$ | H | H | H | H |
| FD-18 | 2-OH, 5-COOH | H | H | H | H |
| FD-19 | 4-$NHSO_2CH_3$ | H | H | $C_2H_5$ | H |

*TEAH = triethylammonium

In a preferred embodiment, the dye of Formula (I) contains an ionizable group, for example, FD-1, FD-2, FD-4, FD-6, FD-10, FD-16, FD-18 and FD-19. In another preferred embodiment, $R^3$ and $R^4$ are both hydrogen.

In Formula (I), M is a cation. Preferred cations are $H^+$, $Na^+$, $K^+$, triethyl ammonium ($TEAH^+$), pyridinium, etc. $H^+$ and $TEAH^+$ are particularly preferred.

The filter dyes of this invention can be incorporated into the photographic element in any of the ways known in the art. They may be added directly to, or dispersed in film forming polymeric vehicles and/or binders, as is well known in the art. These include both naturally occurring and synthetic binders, such as gelatin and gelatin derivatives, polyvinyl alcohols, acrylamide polymers, polyvinyl acetates, polyacrylates and the like. In certain instances, especially where the dye is mobile (e.g., a dye with one or more $SO_3^-$ constituents) it may be advantageous to use the dye in combination with a mordant, such as polyvinylimidazole and polyvinylpyridine, to aid in immobilizing the dye. The technology of mordanting dyes is well known in the art, and is described in further detail in Jones et al U.S. Pat. No. 3,282,699 and Heseltine et al U.S. Pat. Nos. 3,255,693 and 3,483,779. An oil-in-water dispersion of the dye may be prepared by dissolving the dye in an organic liquid, forming a premix with an aqueous phase containing dispersing aids such as water-soluble surfactants, polymers and film forming binders such as gelatin, and passing the premix through a mill until the desired particle size is obtained. The mill can be any high energy device such as a colloid mill, high pressure homogenizer, ultrasonic device, or the like. Preparation of conventional oil-in-water dispersions are well known in the art and are described in further detail in Jelly and Vittum U.S. Pat. No. 2,322,027. The dyes can also be loaded into a latex polymer, either during or after polymerization, and the latex can be dispersed in a binder. Additional disclosure in loaded latexes can be found in Milliken U.S. Pat. No. 3,418,127.

In a preferred embodiment, the dye is dispersed in the binder in the form of a solid particle dispersion. Such dispersions are formed by either milling the dye in solid form until the desired particle size range is reached, or by precipitating the dye directly in the form of a solid particle dispersion. In the case of solid particle milling dispersal methods, a coarse aqueous premix, containing the filter dye and water, and optionally, any desired combination of water soluble surfactants and polymers, is made, and added to this premix prior to the milling operation. The resulting mixture is then loaded into a mill. The mill can be, for example, a ball mill, media mill, jet mill, attritor mill, vibratory mill, or the like. The mill is charged with the appropriate milling media such as, for example, beads of silica, silicon nitride, sand, zirconium oxide, yttria-stabilized zirconium oxide, alumina, titanium, glass, polystyrene, etc. The bead sizes typically range from 0.25 to 3.0 mm in diameter, but smaller media may be used if desired. The solid dye particles in the slurry are subjected to repeated collisions with the milling media, resulting in crystal fracture and consequent particle size reduction. The solid particle dispersions of the dye should have an average particle size of 0.01 to about 10 microns, preferably 0.05 to about 5 microns, and more preferably about 0.05 to about 3 microns. Most preferably, the solid particles are of sub-micron average size. In the case of pH precipitation techniques, an aqueous solution of the dye is made at relatively high pH then the pH is lowered to cause precipitation of the dye. The aqueous dispersion can further contain appropriate surfactants and polymers previously disclosed for use in making pH precipitated dispersions. For solvent precipitation, a solution of the dye is made in some water miscible, organic solvent. The solution of the dye is added to an aqueous solution containing appropriate surfactants and polymers to cause precipitation as previously disclosed for use in making solvent precipitated dispersions.

Surfactants and other additional conventional addenda may also be used in the dispersing process described herein in accordance with prior art solid particle dispersing procedures. Such surfactants, polymers and other addenda are disclosed in U.S. Pat. Nos. 5,468,598, 5,300,394, 5,278,037, 4,006,025, 4,924,916, 4,294,917, 4,940,654, 4,950,586, 4,927,744, 5,279,931, 5,158,863, 5,135,844, 5,091,296, 5,089,380, 5,103,640, 4,990,431, 4,970,139, 5,256,527, 5,015,564, 5,008,179, 4,957,857, and 2,870,012, British Patent specifications Nos. 1,570,362 and 1,131,179 referenced above, the disclosures of with are hereby incorporated by reference, in the dispersing process of the filter dyes.

Additional surfactants or other water soluble polymers may be added after formation of the filter dye dispersion, before or after subsequent addition of the small particle dispersion to an aqueous coating medium for coating onto a photographic element support. The aqueous medium preferably contains other compounds such as stabilizers and dispersants, for example, additional anionic nonionic, zwitterionic, or cationic surfactants, and water soluble binders such as gelatin as is well known in the photographic element art. The aqueous coating medium may further contain other dispersion or emulsions of compounds useful in photography.

The filter dyes of formula (I) can be used together with other filter dyes to obtain a broader spectrum of absorption, if desired. For example, when the filter dye(s) is used to provide anti-halation properties or to permit room light loading, the filter dye(s) should be selected to provide an absorption envelope that matches the sensitization envelope of the light sensitive layer(s) of the photographic element. More than one dye of Formula (I) can be used or one or more dyes of formula (I) can be used together with another filter dye. Other filter dyes that can be used include, for example, the filter dyes disclosed in U.S. Pat. Nos. 2,538,008, 2,538,009, and 4,420,555, and UK Patents Nos. 695,873 and 760,739. It is preferred to use the filter dyes as solid particle dispersions as disclosed in U.S. Pat. Nos. 4,950,586, 4,948,718, 4,948,717, 4,940,654, 4,923,788, 4,900,653, 4,861,700, 4,857,446, 4,855,221, 5,213,956 and 5,213,957, and European Patent No. 430,186. The entire disclosures of the above patents are incorporated herein by reference.

In a preferred embodiment of the invention, the black and white photographic element comprises at least one of the silver halide light sensitive layer which contains a sensitizing dye of Formula (II):

(II)

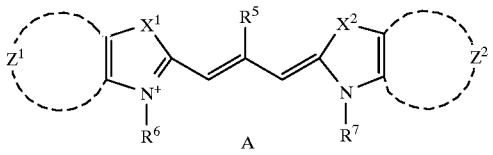

wherein $X^1$ and $X^2$ are independently O, S, or Se; $Z^1$ and $Z^2$ represent the atoms necessary to complete an unsubstituted or substituted benzene group or an unsubstituted or substituted naphthalene group; $R^5$ is a hydrogen atom or an unsubstituted or substituted alkyl group, such as methyl, ethyl, etc.; and $R^6$ and $R^7$ are each independently an unsubstituted or substituted alkyl, such as methyl, ethyl, etc.;, unsubstituted or substituted aryl, such as phenyl, naphthyl, etc.; or unsubstituted or substituted alkenyl group, such as ethene, propene, butene, etc.; and A is a counterion as needed to balance the charge of the dye. In preferred embodiments of the invention $R^6$ and/or $R^7$ is substituted with a sulfo or carboxyl group.

Preferred sensitizing dyes of formula (II) are:

SD-1

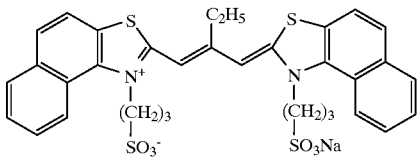

SD-2

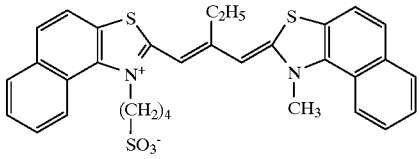

SD-3

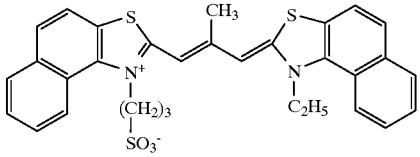

SD-4

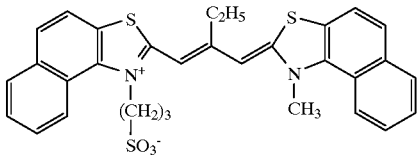

SD-5

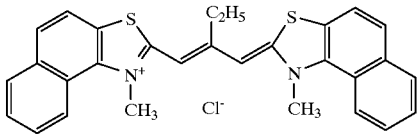

SD-6

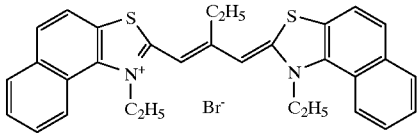

SD-7

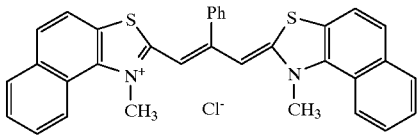

-continued
SD-8
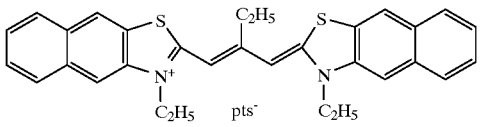
(pts⁻ is p-toulene sulfonate)
SD-9
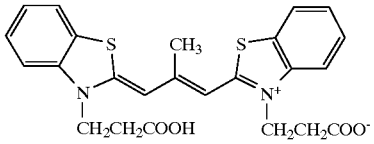
SD-10
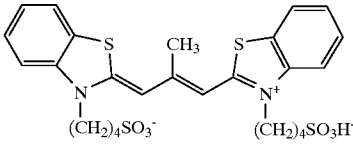
SD-11
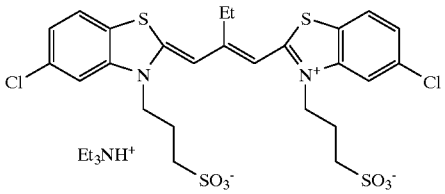
SD-12
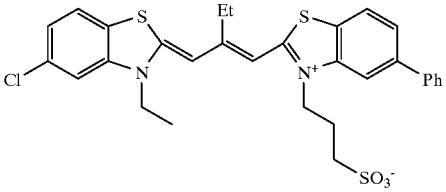
SD-13
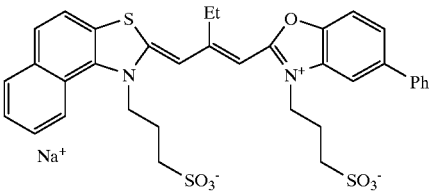
SD-14
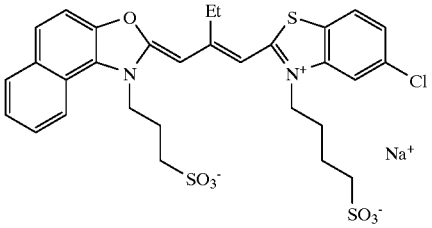
-continued
SD-15
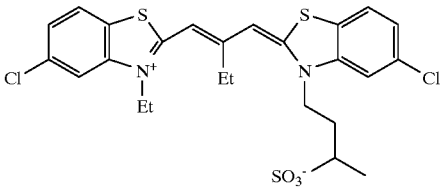
SD-16
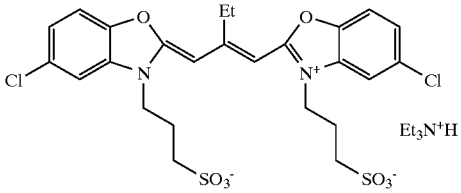
SD-17
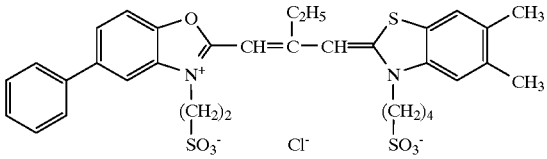
SD-18
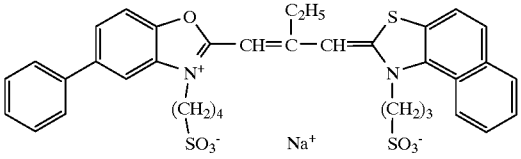
SD-19
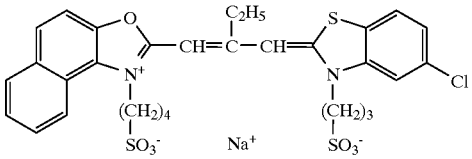
SD-20
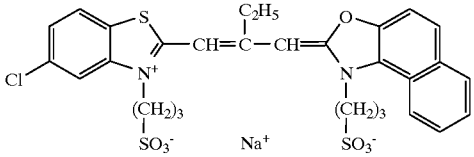
Other preferred sensitizing dyes are the following compounds:

SD-21
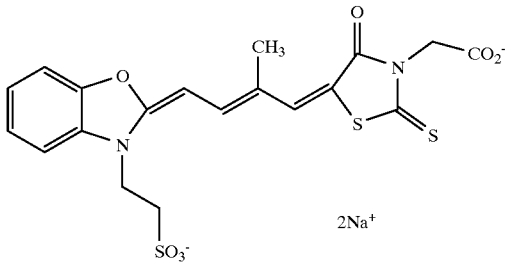
SD-22
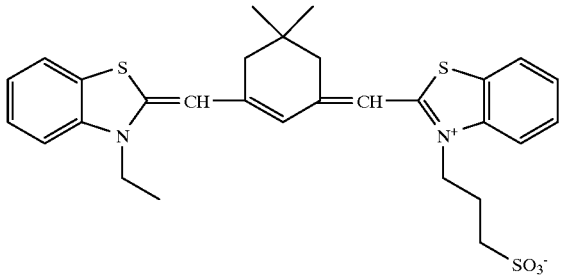
SD-23
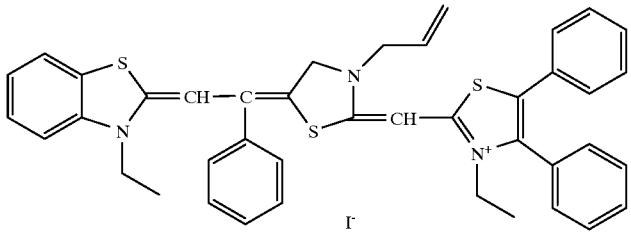
SD-24
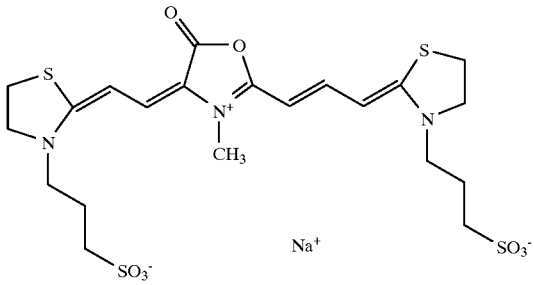
SD-25
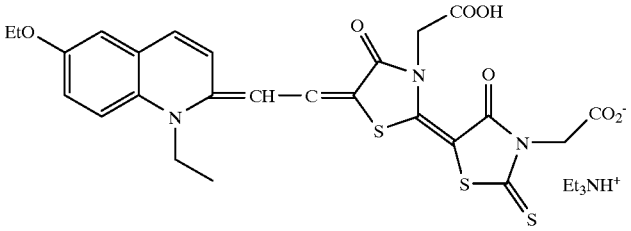

-continued

SD-26

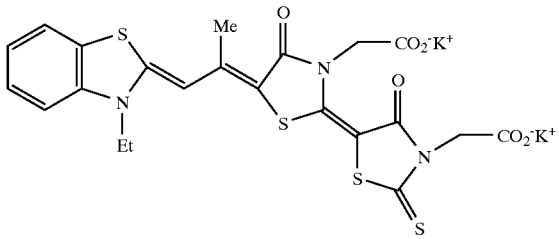

SD-27

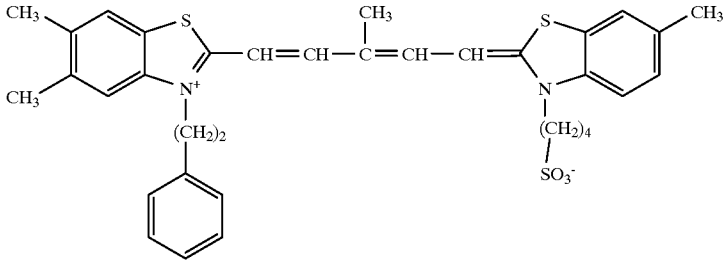

SD-28

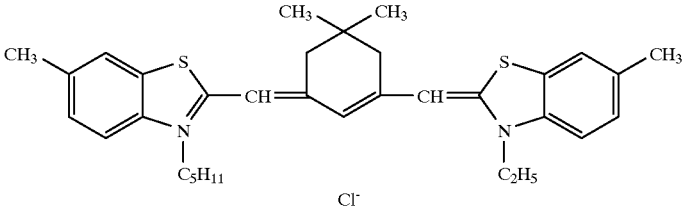

In the discussion of filter dyes of formula (I) or sensitizing dyes of formula (II), a reference to a particular moiety as a "group", means that the moiety may itself be unsubstituted or substituted with one or more substituents (up to the maximum possible number). For example, "alkyl group" refers to a substituted or unsubstituted alkyl, while "benzene group" refers to a substituted or unsubstituted benzene (with up to six substituents). Generally, unless otherwise specifically stated, substituent groups usable on molecules herein include any groups, whether substituted or unsubstituted, which do not destroy properties necessary for the photographic utility. Examples of substituents on any of the mentioned groups can include known substituents, such as: halogen, for example, chloro, fluoro, bromo, iodo; alkoxy, particularly "lower alkoxy" (that is, with 1 to 6 carbon atoms, for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups such as any of those described below; and others known in the art. Alkyl substituents may specifically include "lower alkyl" (that is, having 1–6 carbon atoms), for example, methyl, ethyl, and the like. Further, with regard to any alkyl group or alkylene group, it will be understood that these can be branched or unbranched and include ring structures.

Also, a reference to any broader formula includes reference to compounds with a narrower formula within the broader formula (for example, reference to a broader formula having particular substituents includes the possibility of narrower formulae following within the broader formula, having the same substituents where possible unless otherwise indicated).

The dyes of Formulas (I) and (II) can be prepared by synthetic techniques well-known in the art, as illustrated by the synthetic examples below. Such techniques are further illustrated, for example, in "*The Cyanine Dyes and Related Compounds*", Frances Hamer, Interscience Publishers, 1964. The dyes of Formula (II) can be used to sensitize a silver halide emulsion by conventional techniques, for example as disclosed in *Research Disclosure*, September 1994, Number 365, Item 36544, Section V, the disclosure of which is incorporated herein by reference.

The support of the element of the invention can be any of a number of well-known support, such as cellulose acetate, poly(ethylene terephthalate), poly(ethylene naphthalate) or the like.

Photographic elements of the present invention may usefully include a magnetic recording material as described in *Research Disclosure*, Item 34390, November 1992, or a transparent magnetic recording layer such as a layer containing magnetic particles on the underside of a transparent support as in U.S. Pat. Nos. 4,279,945 and 4,302,523. The element typically will have a total thickness (excluding the support) of from 5 to 30 microns.

In the following discussion of suitable materials for use in elements of this invention, reference will be made to *Research Disclosure*, September 1994, Number 365, Item 36544, which will be identified hereafter by the term "*Research Disclosure I*." The Sections hereafter referred to are Sections of the *Research Disclosure I* unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated herein by reference.

Suitable silver halide emulsions and their preparation as well as methods of chemical and spectral sensitization are described in Sections I through V. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections. A typical photographic element of the invention comprises a transparent support, a layer containing the dispersed filter dye adjacent the support, a light sensitive silver halide emulsion layer over the filter dye layer and a protective overcoat top layer. the layer containing the filter dye can be an antihalation layer. In other embodiments of the invention the silver halide emulsion layer is on one side of the support and the filter dye layer is on the opposite side of the support, for example, in the pelloid layer. Processing methods and agents in Sections XIX and XX.

In preferred embodiments of the invention, the photographic element contains a negative working silver halide emulsion and a negative image can be formed.

The photographic elements may also contain materials that accelerate or otherwise modify the processing steps of bleaching or fixing to improve the quality of the image. Bleach accelerators described in EP 193 389; EP 301 477; U.S. Pat. Nos. 4,163,669; 4,865,956; and 4,923,784 are particularly useful. Also contemplated is the use of nucleating agents, development accelerators or their precursors (UK Patent 2,097,140; U.K. Patent 2,131,188); electron transfer agents (U.S. Pat. Nos. 4,859,578; 4,912,025); antifogging agents such as derivatives of hydroquinones, aminophenols, amines, gallic acid; catechol; ascorbic acid; hydrazides; sulfonamidophenols.

The silver halide used in the photographic elements may be silver iodobromide, silver bromide, silver chloride, silver chlorobromide, silver chloroiodobromide, and the like.

The type of silver halide grains preferably include polymorphic, cubic, and octahedral. The grain size of the silver halide may have any distribution known to be useful in photographic compositions, and may be either polydipersed or monodispersed.

The silver halide grains to be used in the invention may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

Dopants can be employed to modify grain structure and properties as disclosed in *Research Disclosure I* section I-C(3) and *Research Disclosure*, Item 3736, November 1994. Typical dopants include Periods 3–7 ions including Group VIII metal ions (Fe, Co, Ni and the platinum metals, Ru, Rh, Pd, Re, Os, Ir and Pt), Mg, Al, Ca, Sc, Ti, V, Cr, Mn, Cu, Zn, Ga, As, Se, Sr, Y, Mo, Zr, Nb, Cd, In, Sn, Sb, Ba, La, W, Au, Hg, Tl, Pb, Bi, Ce and U. The dopants can be introduced during the precipitation step during the formation of the silver halide grains.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30 to 80° C., as described in *Research Disclosure I*, Section IV (pages 510–511) and the references cited therein.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

Photographic elements of the present invention are preferably imagewise exposed from a stored image (such as a computer stored image) by means of light emitting devices (such as light emitting diodes, lasers, CRTs and the like).

Photographic elements of the invention can be processed in any of a number of well-known photographic processes utilizing any of a number of well-known processing compositions, described, for example, in *Research Disclosure I*, or in T. H. James, editor, *The Theory of the Photographic Process,* 4th Edition, Macmillan, New York, 1977.

Development is followed by fixing, washing and drying.

By reference to "under", "above", "below", "upper", "lower" or the like terms in relation to layer structure of a photographic element, is meant in this application, the relative position in relation to light when the element is exposed in a normal manner. "Above" or "upper" would mean closer to the light source when the element is exposed normally, while "below" or "lower" would mean further from the light source. Since a typical photographic element has the various layers coated on a support, "above" or "upper" would mean further from the support, while "below" or "under" would mean closer to the support.

The following examples illustrate photographic elements in accordance with the invention.

EXAMPLE 1

Solid particle dispersions of the dyes FD-1, FD-2, FD-3, FD-4, FD-5, COMP-1, and YFD-1 were prepared by adding 1 g dye, 0.6 g of a 10% aqueous solution of Luviskol K30, (poly-vinyl pyrrolidone commercially available from BASF), 0.8 g of a 10% aqueous solution of TX-200 octylphenoxy ethylene oxide sulfonate (Union Carbide), 20 g of high-purity water and 60 ml of 1.8 mm zirconium beads to a 120-ml glass jar. The jar was placed on a SWECO vibratory mill for 4 days. After milling, the final dispersions had well-dispersed particles with an average size less than 1 micron.

COMP-1 is a filter dye used commercially in microfilm and is of the formula:

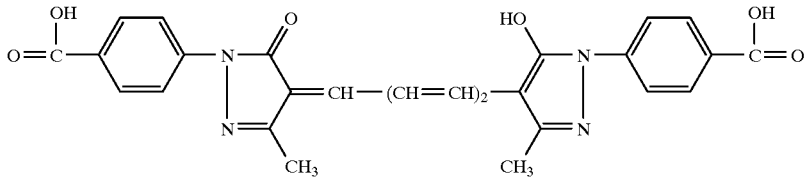

YFD-1 is a yellow dye used commercially together with COMP-1 in certain microfilm products and is of the formula:

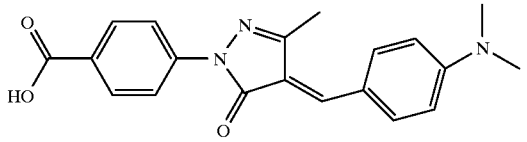

The dye dispersions were evaluated in a 3-layer film structure coated on transparent PET film support as follows:

The solid particle dye dispersions were evaluated in a 3-layer structure coated on transparent PET film support.

The first layer coated on the support contained 175 mg/ft$^2$ (1884 mg/m$^2$) of gelatin, surfactant, 3.0 mg/ft$^2$ (32.3 mg/m$^2$) of YFD-1 as a solid particle dispersion and 7.5 mg/ft$^2$ (80.7 mg/m$^2$) of the test dye as a solid particle dispersion.

The second layer contained a photographic emulsion coated at 93 mg Ag/ft$^2$ (1000 mg Ag/m$^2$), 98 mg of gelatin/ft$^2$ (1055 mg of gelatin/m$^2$) and a surfactant, TX-200 octylphenoxy ethylene oxide sulfonate (Union Carbide). The photographic emulsion was a mono-disperse cubic AgBrI (97:3) emulsion chemically sensitized with 3-methyl-1,3-benzothiazolium iodide, KSeCN, $Na_2S_2O_3.5\ H_2O$, $Au_2S$, and spectrally sensitized with 470 mg SD-1/Ag mole which imparted a sensitivity maximum at 680 nm.

The third layer was a protective overcoat containing 85 mg gelatin/ft$^2$ (914.9 mg gelatin/m$^2$) plus a surfactant. The gelatin containing layers were hardened with bis(vinyl sulfonyl) methane (BVSM) at 2% by weight, based on the total weight of gelatin.

The dried coatings were given 85 micro-second exposures to a xenon flash light source using a calibrated neutral step tablet (0–3 density range) and a Wratten 29 filter and processed in a Kodak Prostar™ processor using Kodak Prostar Plus™ processing solutions.

Additional film samples were incubated for 72 hrs at 32° C. and 80% relative humidity before sensitometric exposure and testing.

The coatings were further tested for halation latitude and tolerance to room light loading as follows:

The halation latitude test produced two sensitometric type curves (Xenon flash at 10 exp-2 sec. A Wratten 29 filter was used for the samples in Table 1, but not for those in Table 2) that represented exposure by halation and by normal exposure. The "halation" curve was compared with the normally exposed curve by measuring the log E separation of the two at a fixed density point (D=0.70 for the samples in Table 1 and D=1.2 for the samples in Table 2). A greater separation between the two curves (larger number) indicated greater protection from halation effects.

The roomlight load protection test simulated the fogging effect of roomlight on the outer laps of a roll of film (Diam~3.5 in.) as it is loaded into a microfilm camera under normal office illumination. A stack of ten 35 mm film strips were exposed through the back with a calibrated neutral density step tablet (0–6 density range) and a 3000 K tungsten lamp for a 13 sec. exposure. After processing in a Kodak Prostar™ processor, using Kodak Prostar PLUS™ processing solutions, the densities of the ten sensitometric exposures were read and a Density vs. Log E plot was generated for each strip. The curves were then examined (at D=0.7 for the samples in Table 1 and at D=1.2 for the samples in Table 2) to determine the total number of laps of film that had been fogged. The data in Tables 1 and 2 is the number of laps that were fogged based on a film roll diameter of 3.5 in. A smaller number is better. The results are given in Table 1.

TABLE 1

| test dye | Dmin | log speed at 0.7 density | 72 h/32° C./80% RH, Δlog speed | halation latitude (logH) | roomlight load protection (Laps of fogged film) |
|---|---|---|---|---|---|
| COMP-1 | .045 | 72 | −15 | 1.9 | 7.4 |
| FD-1 | .055 | 77 | +1 | 2.5 | 5.7 |
| FD-2 | .040 | 71 | −1 | 2.1 | 5.3 |
| FD-3 | .120 | 79 | −1 | 2.1 | 5.6 |
| FD-4 | .040 | 72 | −6 | 2.0 | 5.8 |
| FD-5 + FD-1 | .095 | 78 | 0 | 2.2 | 5.7 |

Compared to the well known COMP-1, the dyes used in accordance with this invention give comparable speed, better keeping, and improved halation latitude and roomlight load protection in this red sensitive microfilm. Dmin results indicate that the best dyes in this class also have superior wash-out characteristics. The 2 dyes that did not wash-out completely in this example FD-3 AND FD-5 still retain all the other useful properties.

EXAMPLE 2

This is similar to Example 1 except that the photographic emulsion coated in the second layer was a 0.27 μm (ECD) cubic AgBrI (97:3) emulsion and it was spectrally sensitized with 400 mg/Ag mole of sensitizing dye, SD-9 imparting a broad spectral sensitization with sensitivity maxima at 520 nm and 590 nm, typical of a source document microfilm. The emulsion was coated at 130 mg Ag/ft$^2$ (1399 mg Ag/m$^2$) and 144 mg gelatin/ft$^2$ (1550 mg gelatin/m$^2$).

The dried coatings were given 1/50 sec. exposures to a 2850° K tungsten light source using a calibrated step tablet (0–3 density range) and processed in a Kodak Prostar™ processor using Kodak Prostar Plus™ processing solutions. Incubations and additional testing were the same as in Example 1. The results are given in Table 2.

TABLE 2

| test dye | Dmin | log speed at 1.0 density | 72 h/32° C./ 80% RH, Δlog speed | halation latitude | roomlight load protection |
|---|---|---|---|---|---|
| COMP-1 | .035 | 138 | −39 | 2.1 | 4.2 |
| FD-4 | .025 | 139 | −10 | 2.1 | 4.3 |
| FD-2 | .025 | 138 | 1 | 2.0 | 4.2 |
| FD-6 | .025 | 141 | 1 | 1.9 | 4.4 |

Compared to the well-known COMP-1, the dyes used in accordance with this invention give improved keeping and comparable halation latitude and room light load protection in this pan sensitized microfilm. The Dmin results show that the dyes have low staining properties.

The invention has been described in detail with particular reference to preferred embodiments, but it will be understood that variations and modifications can be effected within the spirit and scope of the invention.

What is claimed is:

1. A black and white photographic element comprising at least one silver halide light sensitive layer and at least one non-light sensitive, hydrophilic colloid layer, wherein the non-light sensitive layer comprises a solid particle dye dispersion of a filter dye of Formula (I):

(I)

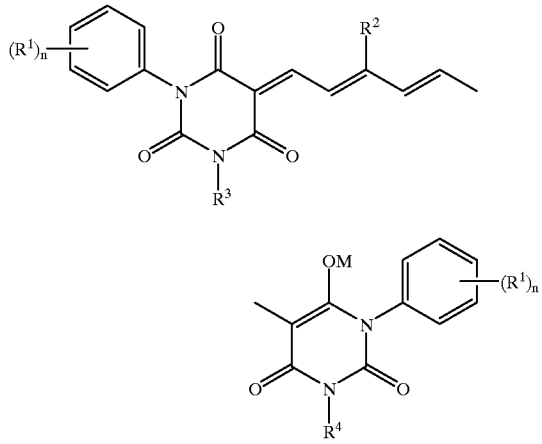

wherein:

each $R^1$ is independently substituted or unsubstituted alkyl, substituted or unsubstituted alkoxy, cyano, hydroxy, carboxy, substituted or unsubstituted amido, or substituted or unsubstituted sulfonamido with the proviso that at least one $R^1$ contains an ionizable group;

n is 1–4;

$R^2$ is H, substituted or unsubstituted alkyl;

each of $R^3$ and $R^4$ is independently hydrogen or substituted or unsubstituted alkyl; and M is a cation.

2. A photographic element according to claim 1, wherein $R^3$ and $R^4$ are both hydrogen.

3. A photographic element according to claim 1, wherein $R^2$ is hydrogen, methyl or ethyl.

4. A photographic element according to claim 1, wherein n is 1, and $R^1$ is hydroxy, carboxy, or sulfonamido.

5. A photographic element according to claim 1, wherein M is $H^+$ or $TEAH^+$.

6. A photographic element according to claim 1, wherein the non-light sensitive layer containing the filter dye of Formula (I) is an antihalation layer.

7. A photographic element according to claim 1, wherein the non-light sensitive layer containing the filter dye of Formula (I) is a pelloid layer.

8. A photographic element according to claim 1, wherein the silver halide layer contains a sensitizing dye of Formula (II):

(II)

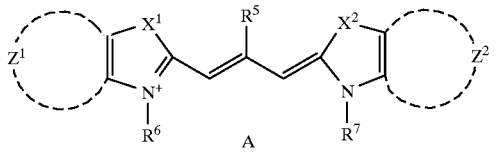

wherein $X^1$ and $X^2$ are independently O, S, or Se; $Z^1$ and $Z^2$ represent the atoms necessary to complete a unsubstituted or substituted benzene group or unsubstituted or substituted naphthalene group; $R^5$ is H, a unsubstituted or substituted alkyl group or a unsubstituted or substituted aryl group; and $R^6$ and $R^7$ are each independently an unsubstituted or substituted alkyl, unsubstituted or substituted aryl or unsubstituted or substituted alkenyl group and A is a counterion as needed to balance the charge of the dye.

9. A photographic element according to claim 8, wherein at least one of $Z^1$ and $Z^2$ is a naphthalene group.

10. A photographic element according to claim 8, wherein both $Z^1$ an $Z^2$ are naphthalene groups.

11. A photographic element according to claim 8, wherein both $Z^1$ an $Z^2$ are substituted or unsubstituted benzene groups.

12. A photographic element according to claim 8, wherein $R^5$ is methyl or ethyl.

13. A photographic element according to claim 1, wherein the silver halide layer contains a sensitizing dye of the formula:

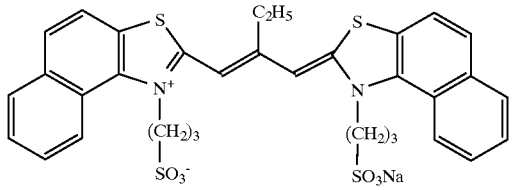

-continued
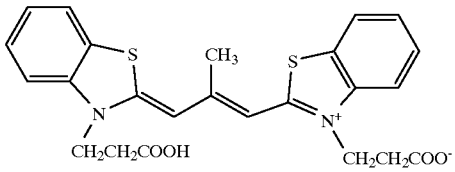
or
-continued
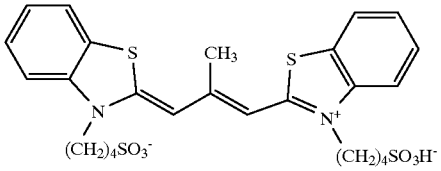
14. A photographic element according to claim 1, wherein the dye of formula (I) is of the formula:
FD-1
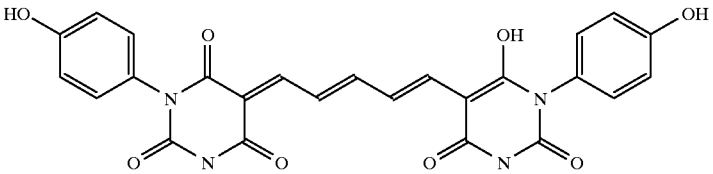
FD-2
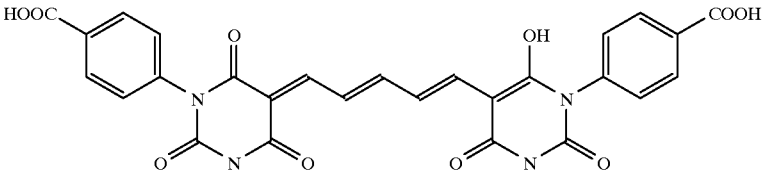
FD-4
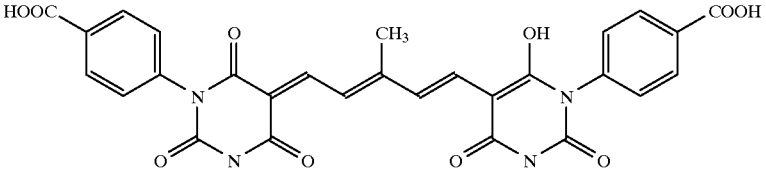
FD-6
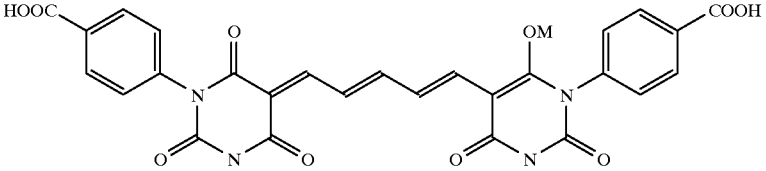
where M is triethyl ammonium
FD-10
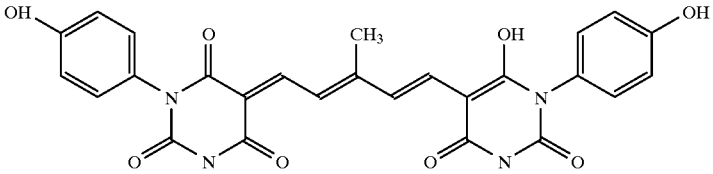
* * * * *